US010170241B2

(12) United States Patent
Jang et al.

(10) Patent No.: US 10,170,241 B2
(45) Date of Patent: Jan. 1, 2019

(54) MULTILAYER ELECTRONIC COMPONENT AND METHOD OF MANUFACTURING THE SAME

(71) Applicant: Samsung Electro-Mechanics Co., Ltd., Suwon-si (KR)

(72) Inventors: Su Bong Jang, Suwon-si (KR); Sang Jong Lee, Suwon-si (KR); Tae Ho Yun, Suwon-si (KR); Han Kim, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 36 days.

(21) Appl. No.: 15/183,035

(22) Filed: Jun. 15, 2016

(65) Prior Publication Data

US 2017/0110236 A1 Apr. 20, 2017

(30) Foreign Application Priority Data

Oct. 19, 2015 (KR) ..... 10-2015-0145520

(51) Int. Cl.

| | |
|---|---|
| ***H01F 5/00*** | (2006.01) |
| ***H01F 41/10*** | (2006.01) |
| ***H01F 17/00*** | (2006.01) |
| ***H01F 27/29*** | (2006.01) |
| ***H01F 41/04*** | (2006.01) |
| *H01F 17/04* | (2006.01) |

(52) U.S. Cl.

CPC ..... *H01F 41/10* (2013.01); *H01F 5/00* (2013.01); *H01F 17/0013* (2013.01); *H01F 27/292* (2013.01); *H01F 41/043* (2013.01); *H01F 17/04* (2013.01)

(58) Field of Classification Search

CPC ..... H01F 5/00; H01F 27/00–27/36
USPC ..... 336/65, 83, 200, 206–208, 232–234
See application file for complete search history.

(56) References Cited

U.S. PATENT DOCUMENTS

2002/0105405 A1 8/2002 Lee et al.
2013/0214889 A1* 8/2013 Kim ..... H01F 17/0033 336/192

FOREIGN PATENT DOCUMENTS

| | | | |
|---|---|---|---|
| JP | 2011-14940 | A | 1/2011 |
| KR | 2001-0076787 | A | 8/2001 |
| KR | 10-2009-0035789 | A | 4/2009 |

* cited by examiner

*Primary Examiner* — Tuyen Nguyen
(74) *Attorney, Agent, or Firm* — NSIP Law

(57) ABSTRACT

A multilayer electronic component includes: a multilayer body includes stacked insulating layers and internal coil parts disposed on the insulating layers; external electrodes disposed on an outer portion of the multilayer body and connected to the internal coil parts; and a material layer disposed on an outermost coil part among the internal coil parts and having a specific resistance that is lower than a specific resistance of the internal coil parts.

7 Claims, 3 Drawing Sheets

MULTILAYER ELECTRONIC COMPONENT AND METHOD OF MANUFACTURING THE SAME

CROSS-REFERENCE TO RELATED APPLICATIONS

This application claims the benefit of Korean Patent Application No. 10-2015-0145520 filed on Oct. 19, 2015 in the Korean Intellectual Property Office, the entire disclosure of which is incorporated herein by reference for all purposes.

BACKGROUND

1. Field

The following description relates to a multilayer electronic component and a method of manufacturing the same.

2. Description of Related Art

An inductor is a representative passive electronic component that can be combined with a resistor and a capacitor to form an electronic circuit configured to remove noise. An inductor may be combined with a capacitor using electromagnetic characteristics to configure a resonance circuit, such as a filter circuit or the like, that amplifies a signal in a specific frequency band.

In a case of a multilayer inductor, inductance may be implemented by forming coil patterns on respective insulator sheets that are primarily formed of a magnetic material, using a conductive paste, or the like, and stacking the insulator sheets to form a coil in a sintered multilayer body.

One known type of inductor is a perpendicular multilayer inductor including an internal coil formed in a plane perpendicular to a substrate mounting surface in order to provide higher inductance. The perpendicular multilayer inductor may obtain a high inductance value in comparison to a multilayer inductor in which an internal coil is formed in a horizontal direction, and may increase a self resonant frequency.

A high-frequency inductor, which is a product having an open magnetic path using a dielectric material, has a problem in that equivalent series resistance may increase in a high frequency region due to a loss of magnetic flux and parasitic capacitance generated between internal metals or between internal and external metals, resulting in a Q factor of the inductor being deteriorated. In particular, equivalent series resistance (Rs) is represented as a sum of a direct current (DC) resistance which is constant regardless of a change in frequency and an alternating current (AC) resistance of which a magnitude and a value are changed depending on a change in AC frequency. The AC resistance, which is an imaginary component of impedance, is not simply consumed as heat energy unlike the DC resistance (Rdc), but since inductance accumulates energy as a magnetic field and capacitance accumulates energy as an electric field, the AC resistance is loss-free resistance. However, since a signal which should flow in the frequency is accumulated as the electric field and the magnetic field and is thereby congested, the signal may be considered to be lost, and thus the signal may be classified as a resistance component.

The AC resistance increases due to a skin effect resulting from an increase in the AC frequency and a parasitic effect, and the equivalent series resistance (Rs) may increase. That is, as an interlayer distance between coils and a distance between the coil and external electrodes is decreased, the equivalent series resistance (Rs) may increase due to the parasitic effect and an increase in parasitic capacitance. As the frequency is increased, the equivalent series resistance (Rs) is increased due to the skin effect, thereby deteriorating the Q factor.

It is therefore desirable to improve the Q factor of a multilayer electronic component by decreasing the parasitic capacitance generated between the internal metals of the electronic component or between the internal and external metals of the electronic component to decrease the equivalent series resistance (Rs), and by decreasing the loss of the magnetic flux to increase an inductance value of the electronic component.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a multilayer body includes: stacked insulating layers and internal coil parts disposed on the insulating layers; external electrodes disposed on an outer portion of the multilayer body and connected to the internal coil parts; and a material layer disposed on an outermost internal coil part among the internal coil parts and having a specific resistance that is lower than a specific resistance of the internal coil parts The material layer may include silver (Ag).

The internal coil parts may include externally exposed first and second lead portions.

The first and second lead portions may have an L shape in a cross section of the multilayer body in a length-thickness plane.

The multilayer body may further include an externally exposed dummy lead part disposed on the insulating layers.

The internal coil parts may be disposed in planes perpendicular to a substrate mounting surface of the multilayer body.

The external electrodes may be disposed on end surfaces of the multilayer body or a bottom surface of the multilayer body.

In another general aspect, a method of manufacturing a multilayer electronic component includes: preparing insulating sheets; forming internal coil patterns on the insulating sheets; applying a material layer having a specific resistance lower than a specific resistance of the internal coil patterns onto an outermost internal coil pattern among the internal coil patterns; stacking the insulating sheets to form a multilayer body including internal coil parts formed by the internal coil patterns; and forming external electrodes connected to the internal coil parts on an outer portion of the multilayer body.

The material layer may include silver (Ag).

The internal coil parts may include externally exposed first and second lead portions.

The first and second lead portions may have an L shape in a cross section of the multilayer body in a length-thickness plane.

The method may further include forming dummy lead part patterns on the insulating sheets, wherein the multilayer body is further formed by stacking the insulating sheets to dispose the dummy lead part patterns to be adjacent to the first and second lead portions, respectively, and to be exposed at surfaces of the multilayer body perpendicular to a stacking surface of the multilayer body.

The material layer may be formed by a plating method or a printing method.

The internal coil parts may be disposed in planes perpendicular to a substrate mounting surface of the multilayer body.

The forming of the external electrodes may further include forming the external electrodes on end surfaces of the multilayer body or a bottom surface of the multilayer body.

Other features and aspects will be apparent from the following detailed description, the drawings, and the claims.

BRIEF DESCRIPTION OF DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1:
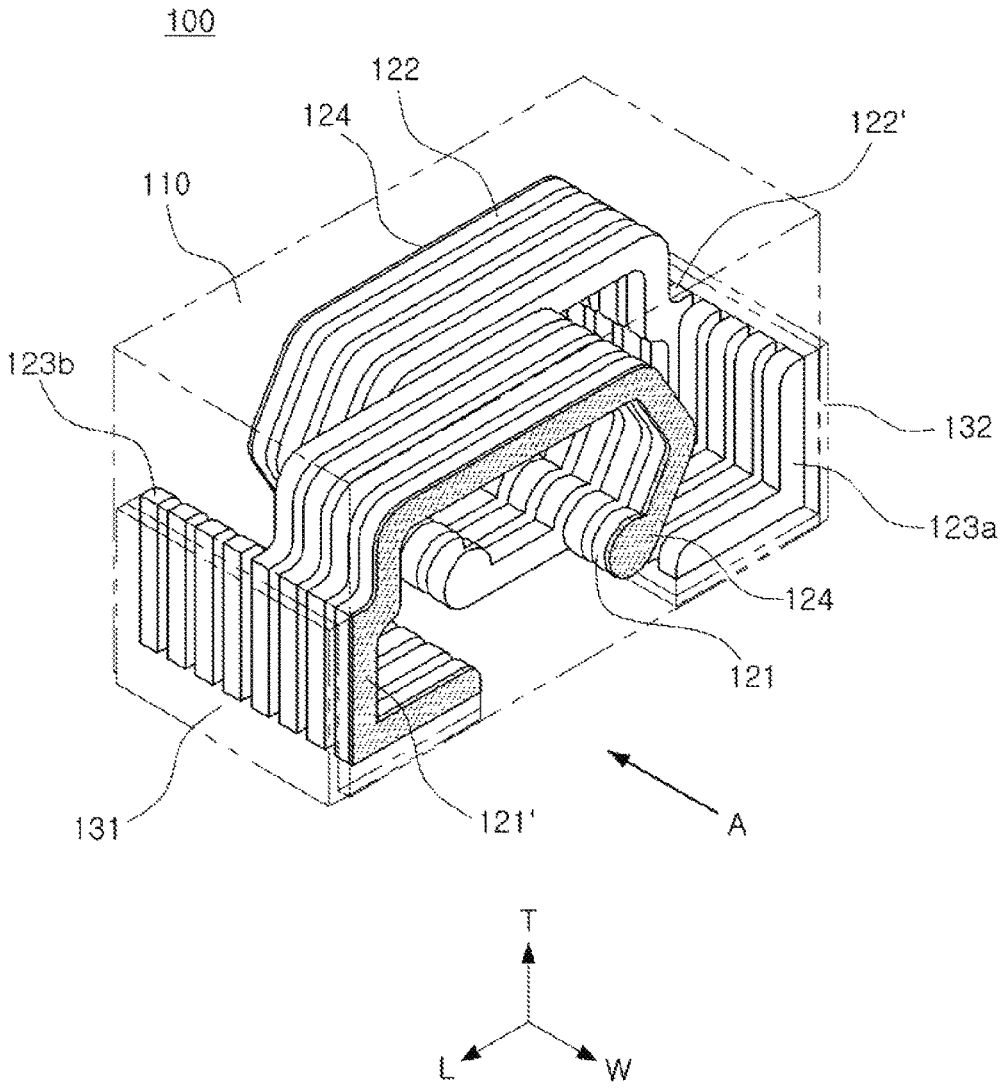
FIG. 1 is a schematic perspective view illustrating a multilayer electronic component, according to an embodiment, such that internal coil parts of the electronic component are shown.

The following detailed description is provided to assist the reader in gaining a comprehensive understanding of the methods, apparatuses, and/or systems described herein. However, various changes, modifications, and equivalents of the methods, apparatuses, and/or systems described herein will be apparent to one of ordinary skill in the art. The sequences of operations described herein are merely examples, and are not limited to those set forth herein, but may be changed as will be apparent to one of ordinary skill in the art, with the exception of operations necessarily occurring in a certain order. Also, descriptions of functions and constructions that are well known to one of ordinary skill in the art may be omitted for increased clarity and conciseness.

The features described herein may be embodied in different forms, and are not to be construed as being limited to the examples described herein. Rather, the examples described herein have been provided so that this disclosure will be thorough and complete, and will convey the full scope of the disclosure to one of ordinary skill in the art.

Throughout the specification, it will be understood that when an element, such as a layer, region or wafer (substrate), is referred to as being "on," "connected to," or "coupled to" another element, it can be directly "on," "connected to," or "coupled to" the other element or other elements intervening therebetween may be present. In contrast, when an element is referred to as being "directly on," "directly connected to," or "directly coupled to" another element, there may be no elements or layers intervening therebetween.

It will be apparent that though the terms first, second, third, etc. may be used herein to describe various members, components, regions, layers and/or sections, these members, components, regions, layers and/or sections should not be limited by these terms. These terms are only used to distinguish one member, component, region, layer or section from another region, layer or section. Thus, a first member, component, region, layer or section discussed below could be termed a second member, component, region, layer or section without departing from the teachings of the disclosed embodiments.

Words describing relative spatial relationships, such as "below", "beneath", "under", "lower", "bottom", "above", "over", "upper", "top", "left", and "right", may be used to conveniently describe spatial relationships of one device or elements with other devices or elements. Such words are to be interpreted as encompassing a device oriented as illustrated in the drawings, and in other orientations in use or operation. For example, an example in which a device includes a second layer disposed above a first layer based on the orientation of the device illustrated in the drawings also encompasses the device when the device is flipped upside down in use or operation.

The terminology used herein describes particular embodiments only, and the present disclosure is not limited thereby. As used herein, the singular forms "a," "an," and "the" are intended to include the plural forms as well, unless the context clearly indicates otherwise.

Hereinafter, embodiments of the disclosure will be described with reference to schematic views illustrating embodiments of the disclosure. In the drawings, for example, due to manufacturing techniques and/or tolerances, modifications of the shape shown may be estimated. Thus, embodiments of the disclosure should not be construed as being limited to the particular shapes of regions shown herein, for example, to include a change in shape resulting from manufacturing. The following embodiments may also be constituted by one or a combination thereof.

Multilayer Electronic Component

FIG. 1 is a schematic perspective view illustrating a multilayer electronic component 100, according to an embodiment, such that internal coil parts of the multilayer electronic component 100 are shown. More specifically, according to the illustrated embodiment, the multilayer electronic component 100 is an inductor. However, a multilayer electronic component according to the disclosure is not limited to an inductor.

Figure 2:
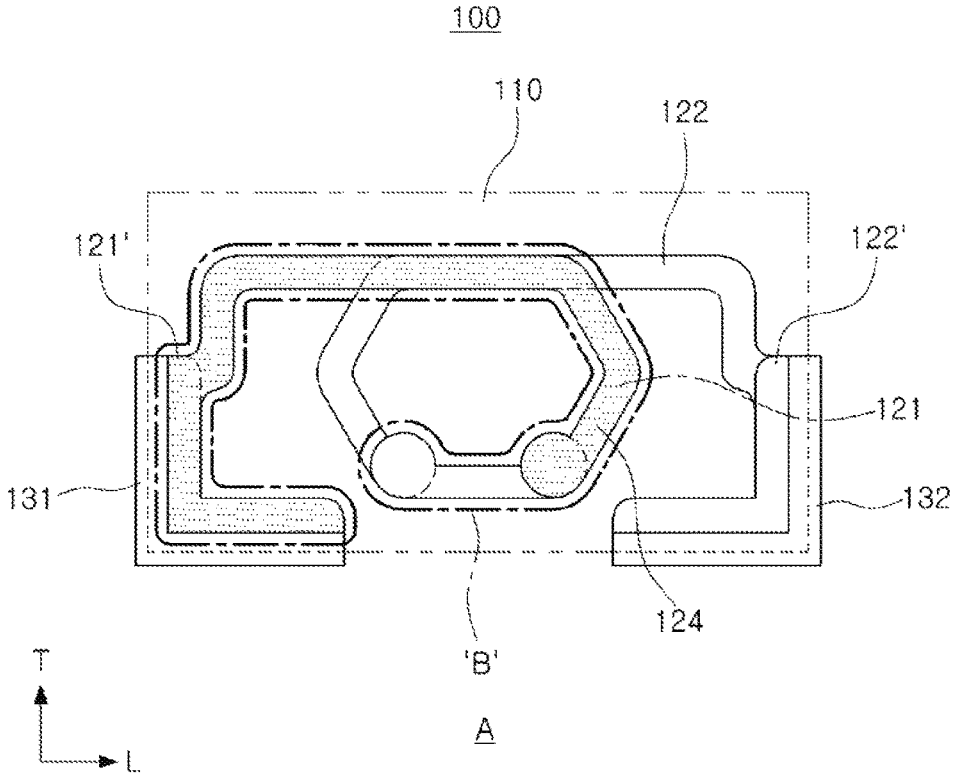
FIG. 2 is a projected view illustrating an interior of the multilayer electronic component in a direction A of FIG. 1.
Figure 3:
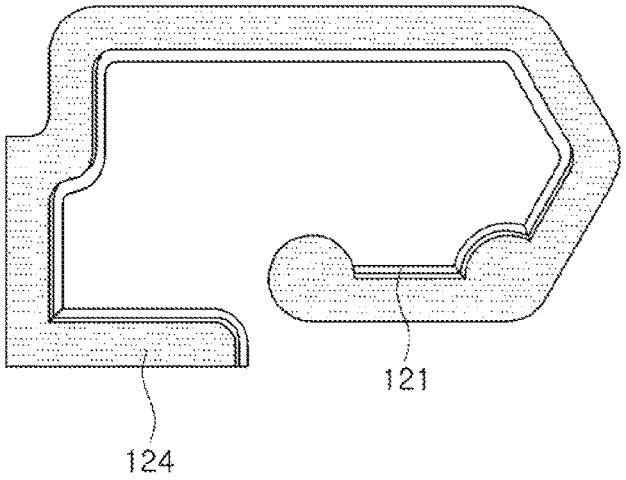
FIG. 3 is an enlarged view of part B of FIG. 2.

FIG. 2 is a projected view illustrating an interior of the multilayer electronic component 100 in a direction A of FIG. 1. FIG. 3 is an enlarged view of part B of FIG. 2. Referring to FIGS. 1 through 3, the multilayer electronic component 100 includes a multilayer body 110, internal coil parts 121 and 122, and first and second external electrodes 131 and 132.

The multilayer body 110 may be formed by stacking insulating layers. The insulating layers may be in a sintered state, and adjacent insulating layers may be integrated in such a manner that it may be difficult to discern a boundary therebetween without using a scanning electron microscope (SEM).

The multilayer body 110 may have a substantially hexahedral shape. Directions L, W, and T illustrated in FIG. 1 refer to a length direction, a width direction, and a thickness direction, respectively, of the hexahedral shape.

The multilayer body 110 may contain ferrite known in the art, such as Mn—Zn based ferrite, Ni—Zn based ferrite, Ni—Zn—Cu based ferrite, Mn—Mg based ferrite, Ba based ferrite, Li based ferrite, or the like.

The internal coil parts 121 and 122 may be formed by printing a conductive paste containing a conductive metal on the insulating layers at a predetermined thickness. The conductive metal forming the internal coil parts 121 and 122 is not particularly limited as long as it has excellent electrical conductivity. For example, the conductive metal may be made of, silver (Ag), palladium (Pd), aluminum (Al), nickel (Ni), titanium (Ti), gold (Au), copper (Cu), platinum (Pt), or the like, or a mixture thereof. In particular, the internal coil parts 121 and 122 may be formed of copper (Cu).

A via may be formed at a predetermined position in each of the insulating layers on which the internal coil part 121 or 122 is formed, and the internal coil parts 121 and 122 may be electrically connected to each other through the via, thereby forming a single coil. In the illustrated embodiment, since the insulating layers on which the internal coil part 121 or 122 is formed are stacked in the width (W) direction or length (L) direction of the multilayer body 110, the internal coil parts 121 and 122 may be disposed in a plane perpendicular to a substrate mounting surface of the multilayer body 110.

The internal coil part 121 may be a first internal coil part exposed at one end surface of the multilayer body 110 perpendicular to the length (L) direction and the internal coil part 122 may be a second internal coil part exposed at another end surface of the multilayer body 110, opposite the one end surface, perpendicular to the length direction.

The first internal coil part 121 includes a first lead portion 121' exposed at a surface of the multilayer body 110 that is perpendicular to a stacking surface of the multilayer body 110, and the second internal coil part 122 includes a second lead portion 122' exposed at a surface of the multilayer body 110 that is perpendicular to the stacking surface of the multilayer body 110. For example, the first and second lead portions 121' and 122' are respectively exposed at opposing end surfaces of the multilayer body 110 perpendicular to the length (L) direction perpendicular to a stacking surface of the insulating layers.

The first and second lead portions 121' and 122' may be exposed at a lower surface of the multilayer body 110, which is the substrate mounting surface of the multilayer body 110. That is, first and second lead portions 121' and 122' may have an 'L' shape in a cross section of the multilayer body 110 in a length-thickness direction.

The first external electrode 131 may be disposed on one end surface of the multilayer body 110 perpendicular to the length direction (L) and the lower surface of the multilayer body 110, and may be connected to the first lead portion 121'. The second external electrode 132 may be disposed on the other end surface of the multilayer body 110 perpendicular to the length direction and the lower surface of the multilayer body 110, and may be connected to the second lead portion 122'. More specifically, the one end surface and the other end surface of the multilayer body 110 may oppose each other in the length direction (L) and may be perpendicular to the stacking surface of the multilayer body 110. The one end surface and the second end surface of the multilayer body 110 may be connected to the first and second lead portions 121' and 122' of the internal coil parts 121 and 122, respectively.

A metal forming the first and second external electrodes 131 and 132 is not limited to a particular type of metal, as long as the metal may be plated. For example, the first and second external electrodes 131 and 132 may be formed of nickel (Ni), tin (Sn), or the like, or a mixture thereof.

Referring to FIG. 3, a material layer 124 having a specific resistance lower than a specific resistance of the internal coil part is disposed on an outermost (in the width (W) direction) internal coil part among the first and second internal coil parts 121 and 122.

In a conventional multilayer inductor, when external electrodes are formed on both end surfaces of a multilayer body perpendicular to a length direction and portions of surfaces of the multilayer body adjacent to both end surfaces by a dipping method using a conductive paste, or by a similar method, a magnetic flux generated by an induced current of a conductor may be blocked, thereby deteriorating the Q factor of the inductor. In particular, in an inductor of which internal coil parts are stacked in a direction perpendicular to a mounting surface of a substrate, in a case in which external electrodes are formed on both end surfaces of the inductor in a length direction, an eddy current may be generated in the external electrodes, which may increase a loss, and stray capacitance may be generated between internal coils and the external electrodes, which may decrease a self resonant frequency of the inductor. Therefore, in a perpendicular multilayer inductor, an attempt has been made to form the external electrodes only on one surface (e.g., a lower surface) of a multilayer body facing a substrate when mounting the inductor on the substrate, or only on end surfaces of the multilayer body perpendicular to a length direction and the lower surface of the multilayer body, to thereby miniaturize the inductor and suppress a loss due to the generation of eddy current.

Meanwhile, a high-frequency inductor, which is a product having an open magnetic path using a dielectric material, has a problem in that equivalent series resistance of the inductor may increase in a high frequency region due to a loss of magnetic flux and parasitic capacitance generated between internal metals or between internal and external metals, and thus a Q factor of the inductor may deteriorate. In particular, equivalent series resistance (Rs) is represented as a sum of a direct current (DC) resistance which is constant regardless of a change in frequency and an alternating current (AC) resistance of which a magnitude and a value change depending on a change in AC frequency. The AC resistance is increased by a skin effect due to an increase in the AC frequency and a parasitic effect, and equivalent series resistance (Rs) may increase. That is, as an interlayer distance between coils and a distance between the coil and external electrodes are decreased, the equivalent series resistance (Rs) may increase due to the parasitic effect and an increase in parasitic capacitance, and as the frequency is increased, the equivalent series resistance (Rs) may increase due to the skin effect, thereby deteriorating the Q factor. According to the embodiment disclosed herein, the Q factor may be improved by disposing the material layer 124 having a specific resistance lower than that of the internal coil part on the outermost internal coil part among the internal coil parts 121 and 122. Since the material layer 124 having a specific resistance lower than that of the internal coil part is disposed on the outermost internal coil parts among the internal coil parts 121 and 122, the material layer 124 may be disposed on surfaces of a coil, among the first internal coil parts 121, that is disposed on one side surface of the multilayer body perpendicular to the width (W) direction and a coil, among the second internal coil parts 122, that is disposed on another (e.g., opposite) side surface of the multilayer body perpendicular to the width (W) direction.

Further, the material layer 124 may be disposed on an outer surface of the outermost internal coil part, that is, a surface of the outermost coil part that is disposed on an outer surface of the multilayer body. Therefore, a Q factor of the multilayer electronic component 100 may be improved.

More specifically, saturation states of a current and a magnetic flux of a portion of the multilayer electronic component 100 on which the current is concentrated may be decreased at a high frequency by coating a material having a low specific resistance value on the outermost internal coil part on which the magnetic flux and the current are concentrated due to the skin effect and the parasitic effect. Thus, AC resistance of the multilayer electronic component 100 may be decreased. As a result, the multilayer electronic component 100 may have an improved Q factor due to the decrease in AC resistance.

The material layer 124 may contain silver (Ag), but is not limited thereto. According to an example, in a case in which the coil is formed of copper (Cu), the material layer 124 is formed of a silver (Ag) material. However, any material may be used for the material layer 124 as long as it has a specific resistance lower than that of the internal coil part 121 or 122.

The multilayer body 110 further includes first and second dummy lead parts 123*a* and 123*b* disposed on the insulating layers and externally exposed. The first dummy lead parts 123*a* may be positioned adjacent to respective first internal coil parts 121 in the length (L) direction on respective insulating layers, and the second dummy lead parts 123*b* may be positioned adjacent to respective second internal coil parts 122 in the length (L) direction on respective insulating layers. Additionally, the first dummy lead parts 123*a* may be positioned adjacent to the second lead portions 122' in the width (W) direction, and the second dummy lead parts 123*b* may be positioned adjacent to the first lead portions 121' in the width (W) direction.

The dummy lead parts 123*a* and 123*b* may be formed in the multilayer body 110 by forming patterns on respective insulating layers in substantially the same shapes as the first and second lead portions 121' and 122', respectively. That is, the multilayer body 110 may be formed by stacking a plurality of the insulating layers on which the first internal coil parts 121, the first lead portions 121' and the first dummy lead parts 123*a* are disposed adjacent, in the width (W) direction, to a plurality of the insulating layers on which the second internal coil parts 122, the second lead portions 122' and the second dummy lead parts 123*b* are disposed.

A larger number of metallic bonds with the external electrodes 131 and 132 disposed on the end surfaces of the multilayer body 110 perpendicular to the length (L) direction and the lower surface of the multilayer body 110 may be formed by stacking the insulating layers in the manner described above, such that the first dummy lead parts 123*a* are formed to be adjacent to the second lead portions 122' in the width (W) direction and the second dummy lead parts 123*b* are formed to be adjacent to the first lead portions 121' in the width (W) direction. Thus, adhesive force between the internal coil parts 121 or 122 and the external electrodes 131 or 132 and adhesive force between the electronic component 100 and a printed circuit board may be improved.

Method of Manufacturing Multilayer Electronic Component

Figure 4:
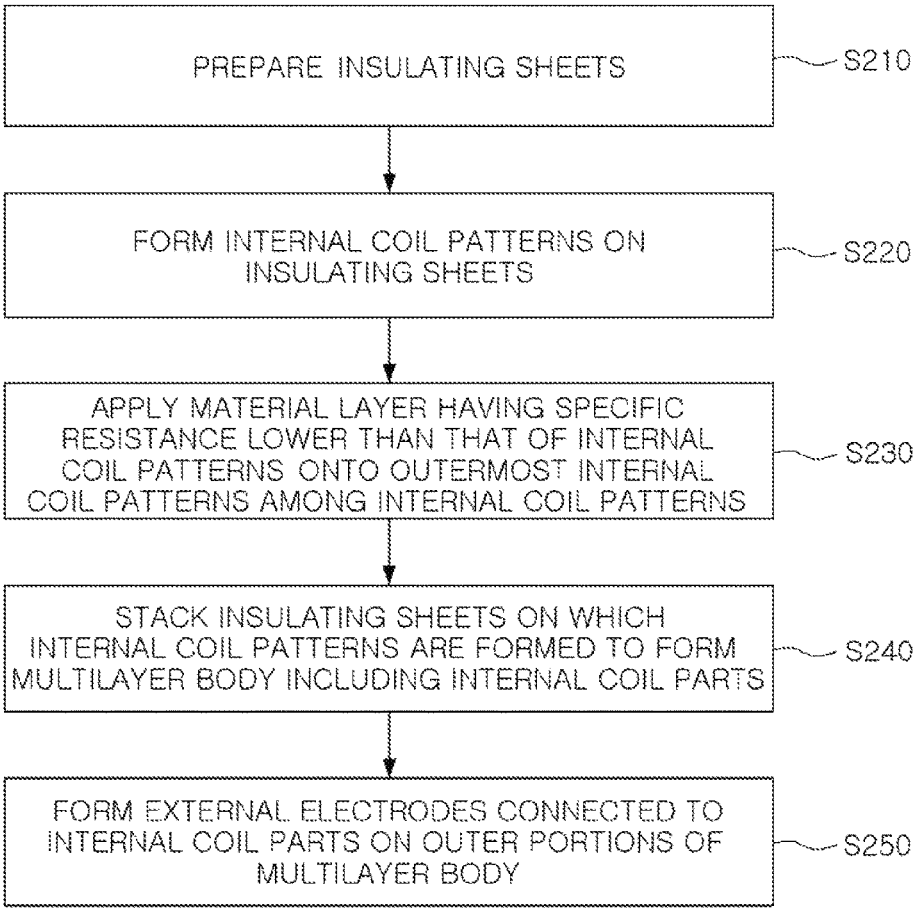
FIG. 4 is a flow chart illustrating a method of manufacturing a multilayer electronic component, according to an embodiment.

FIG. 4 is flow chart illustrating a method of manufacturing a multilayer electronic component, such as the component 100, according to an embodiment. For example, the method of manufacturing the multilayer electronic component includes: preparing insulating sheets; forming internal coil patterns on the insulating sheets; applying a material layer having a specific resistance lower than that of the internal coil patterns onto outermost internal coil patterns among the internal coil patterns; stacking the insulating sheets on which the internal coil patterns are formed to form a multilayer body including internal coil parts; and forming external electrodes connected to the internal coil parts on outer portions of the multilayer body.

Referring to FIG. 4, first, the insulating sheets are prepared in operation S210. A magnetic material is used to manufacture the insulating sheets. The magnetic material of the insulation sheets is not limited to a particular type of magnetic material. For example, ferrite powder known in the art, such as Mn—Zn based ferrite powder, Ni—Zn based ferrite powder, Ni—Zn—Cu based ferrite powder, Mn—Mg based ferrite powder, Ba based ferrite powder, Li based ferrite powder, or the like, may be used.

The insulating sheets may be prepared by applying slurry formed by mixing the magnetic material and an organic material onto a carrier film and drying the applied slurry.

Next, the internal coil patterns are formed on the insulating sheets in operation S220. The internal coil patterns may be formed by applying a conductive paste containing a conductive metal onto the insulating sheets using a printing method, or the like. The printing method of the conductive paste may be a screen printing method, a gravure printing method, or the like. However, the printing method is not limited to the foregoing examples.

The conductive metal is not limited to a particular metal, as long as the metal has excellent electric conductivity. For example, the conductive metal may include silver (Ag), palladium (Pd), aluminum (Al), nickel (Ni), titanium (Ti), gold (Au), copper (Cu), platinum (Pt), or the like, or a mixture thereof.

The internal coil patterns may become the internal coil parts 121 and 122 in the stacking of the insulating sheets to form the multilayer body 110 to be described below, which include the first and second lead portions 121' and 122'. After the forming of the internal coil patterns, a material layer having a specific resistance lower than that of the internal coil pattern is applied on the outermost internal coil patterns among the internal coil patterns in operation S230.

Next, in operation S240, the multilayer body 110 including the internal coil parts 121 and 122 of which the first and second lead portions 121' and 122' are exposed at a lower surface of the multilayer body 110 and surfaces of the multilayer body 110 perpendicular to a stacking surface thereof is formed by stacking the insulating sheets on which the internal coil patterns are formed.

A via may be formed at a predetermined position in each of the insulating layers on which the internal coil patterns are printed, and the internal coil patterns formed on each of the insulating layers may be electrically connected to each other through the via, thereby forming a single coil.

The first and second lead portions 121' and 122' of the internal coil parts 121 and 122 formed as the single coil are exposed at the lower surface of the multilayer body 110 and the surfaces of the multilayer body 110 perpendicular to the stacking surface of the multilayer body 110. The internal coil parts 121 and 122 may be formed in a plane perpendicular to a substrate mounting surface of the multilayer body 110.

Thereafter, in operation S250, first and second external electrodes 131 and 132 connected to the first and second lead portions 121' and 122' of the internal coil parts 121 and 122, respectively, may be formed on the lower surface of the multilayer body 110 and the surfaces of the multilayer body 110 perpendicular to the stacking surface of the multilayer body 110. The first and second external electrodes 131 and 132 may be formed using a conductive paste containing a metal having excellent electric conductivity. The conductive paste may contain one of nickel (Ni) and tin (Sn), an alloy thereof, or the like.

TABLE 1

| Classification | L [nH] | Q | Rs |
|---|---|---|---|
| Comparative Example | 0.440 | 30.764 | 0.216 |
| Example Embodiment | 0.443 | 32.634 | 0.205 |

Referring to Table 1 above, it can be appreciated that in a case of a multilayer electronic component according to the disclosed embodiments, inductance (L) and a Q value were improved, and equivalent series resistance (Rs) was decreased as compared to the Comparative Example according to the related art. Specifically, in the Example Embodiment of Table 1, inductance (L) was increased by 0.7% and the Q value was improved by 6.1% as compared to the Comparative Example.

In addition, it can be appreciated that in the Example Embodiment, equivalent series resistance (Rs) was decreased by 5.1% as compared to the Comparative Example.

A description of other features overlapping those of the multilayer electronic component 100 described above will be omitted in order to avoid repetitive disclosure.

As set forth above, according to example embodiments disclosed herein, equivalent series resistance (Rs) may be decreased by coating a material having a low specific resistance value on outermost internal coil parts on which magnetic flux and current are concentrated due to a skin effect and a parasitic effect. Therefore, a multilayer electronic component having an improved Q factor may be provided.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A multilayer electronic component, comprising:

a multilayer body comprising stacked insulating layers and internal coil parts disposed on the insulating layers;

external electrodes disposed on an outer portion of the multilayer body and connected to the internal coil parts; and a material layer disposed on an outer surface of an outermost internal coil part among the internal coil parts and having a specific resistance that is lower than a specific resistance of the internal coil parts, wherein the outermost coil part is disposed adjacent to a side surface of the multilayer body.

2. The multilayer electronic component of claim 1, wherein the material layer comprises silver (Ag).

3. The multilayer electronic component of claim 1, wherein the internal coil parts comprise externally exposed first and second lead portions.

4. The multilayer electronic component of claim 2, wherein the first and second lead portions have an L shape in a cross section of the multilayer body in a length-thickness plane.

5. The multilayer electronic component of claim 1, wherein the multilayer body further comprises an externally exposed a dummy lead part disposed on the insulating layers.

6. The multilayer electronic component of claim 1, wherein the internal coil parts are disposed in planes perpendicular to a substrate mounting surface of the multilayer body.

7. The multilayer electronic component of claim 1, wherein the external electrodes are disposed on end surfaces of the multilayer body or a bottom surface of the multilayer body.

* * * * *